US008631928B2

(12) United States Patent
Caron et al.

(10) Patent No.: US 8,631,928 B2
(45) Date of Patent: Jan. 21, 2014

(54) CONVEYOR FOR PRINTED SHEET MATERIAL WITH AIR ASSISTED DROP

(75) Inventors: Glen Roger Caron, Dover, NH (US); Glenn Alan Guaraldi, Kingston, NH (US); Richard Craig Meyer, Alfred, ME (US)

(73) Assignee: Goss International Americas, Inc., Durham, NH (US)

( * ) Notice: Subject to any disclaimer, the term of this patent is extended or adjusted under 35 U.S.C. 154(b) by 46 days.

(21) Appl. No.: 10/736,187

(22) Filed: Dec. 15, 2003

(65) Prior Publication Data

US 2005/0126890 A1 Jun. 16, 2005

(51) Int. Cl.
*B65G 49/00* (2006.01)

(52) U.S. Cl.
USPC ..... 198/644; 270/52.2

(58) Field of Classification Search
USPC ..... 198/470, 644, 867.1; 412/11, 12, 19; 414/789.9, 790, 790.2; 270/52.14, 270/52.16, 52.19, 52.23, 52.24
See application file for complete search history.

(56) References Cited

U.S. PATENT DOCUMENTS

| | | | | | |
|---|---|---|---|---|---|
| 3,874,649 | A | | 4/1975 | Bryson et al. | 270/55 |
| 3,934,869 | A | * | 1/1976 | Strobel, Jr. | 271/35 |
| 4,056,264 | A | * | 11/1977 | Dhooge et al. | 271/177 |
| 4,124,203 | A | * | 11/1978 | Muller | 270/52.2 |
| 4,133,521 | A | * | 1/1979 | Muller | 270/52.2 |
| 4,369,587 | A | * | 1/1983 | David | 34/617 |
| 4,373,710 | A | * | 2/1983 | Hansen et al. | 270/52.04 |
| 4,479,643 | A | | 10/1984 | Seidel | 270/55 |
| 4,721,296 | A | * | 1/1988 | Mowry | 270/52.2 |
| 4,723,770 | A | * | 2/1988 | Seidel et al. | 270/52.2 |
| 5,186,443 | A | * | 2/1993 | Manley et al. | 270/1.02 |
| 5,213,318 | A | * | 5/1993 | Newhall | 270/52.2 |
| 5,293,698 | A | * | 3/1994 | Petersen | 34/613 |
| 5,823,320 | A | * | 10/1998 | Seidel et al. | 198/803.5 |
| 5,979,890 | A | * | 11/1999 | Fujimaki et al. | 271/195 |
| 6,082,724 | A | * | 7/2000 | Kahlig et al. | 270/52.14 |
| 6,311,968 | B1 | * | 11/2001 | Linder et al. | 270/52.25 |
| 6,447,229 | B1 | | 9/2002 | Schlough | 412/1 |
| 6,612,567 | B1 | * | 9/2003 | Kaya | 271/206 |
| 6,691,996 | B2 | * | 2/2004 | Kaya et al. | 270/52.25 |
| 6,764,073 | B2 | * | 7/2004 | Kaya et al. | 271/223 |
| 6,830,241 | B1 | * | 12/2004 | Klopfenstein | 270/52.25 |

FOREIGN PATENT DOCUMENTS

| | | | | | |
|---|---|---|---|---|---|
| GB | 2032889 | A | * | 5/1980 | B65H 29/24 |
| JP | 02185472 | A | * | 7/1990 | 400/642 |
| JP | 11255379 | A | * | 9/1999 | B65H 9/10 |

* cited by examiner

*Primary Examiner* — Jeremy R Severson
(74) *Attorney, Agent, or Firm* — Davidson, Davidson & Kappel, LLC

(57) ABSTRACT

A sheet material conveyor includes a pocket conveyor with at least one moving pocket for collecting printed sheet material, the pocket conveyor having a release area for releasing the printing sheet material in the pocket. The sheet material conveyor also includes an air supply device providing air to the pocket at the release area. A pocket with air supply holes and a method for releasing printed sheet material using pressurized air is also provided.

11 Claims, 5 Drawing Sheets

CONVEYOR FOR PRINTED SHEET MATERIAL WITH AIR ASSISTED DROP

BACKGROUND INFORMATION

The present invention relates generally to the graphic arts industry and more particularly to a conveyor for printed sheet material, as well as to a method for transferring printed sheet material.

After printing by a printing press, printed sheet material may be cut, folded and collected into stacks. Newspaper sections for example may be collected together. The collected sheet material is then transferred and conveyed in various manners. The collected sheet material may be for example collected in individual moving pockets. The collected sheet material may be collected by insertion into open sections, or by collation as separate individual sheets or sections are placed side-by-side, or by both insertion and collation.

An example of a pocket conveyor is for example found in U.S. Pat. No. 6,447,229, which prepares spines for binding, which is hereby incorporated by reference herein. U.S. Pat. Nos. 4,479,643 and 3,874,649 also disclose pocket conveyors. Heidelberger Druckmaschinen AG also manufactures the MAGNAPACK pocket conveyor.

The sheet material, once collected, may be transferred to a further conveyor by opening the bottom of the pocket and permitting the printed sheet material to be dropped. For example, Heidelberger Druckmaschinen AG manufactures a gripper called the NP125 which can grip newspaper sections dropped from a pocket conveyor.

BRIEF SUMMARY OF THE INVENTION

Parts of the collected printed sheet material, when dropped from the pocket, may encounter friction against parts of the pocket and thus fall unevenly or become stuck in the pocket. This can cause problems with spine registration or with further conveying of the printed sheet material. As one example, newspaper sections may be collated in the pocket so that a non-glossy newspaper section is located against the pocket wall, and a glossy newspaper section or insert is located next to the non-glossy newspaper section. When the pocket opens to drop the newspaper, the non-glossy newspaper section may fall more slowly or not at all due to the friction caused by the wall, while the glossy section falls quickly due to the reduced friction of the glossy coating. Spine registration is adversely impacted, and malfunction of the entire device may result.

An object of the present invention is to provide a pocket conveyor providing reduced friction during a drop. An alternate or additional object of the present invention is to provide a pocket conveyor which can improve transfer of printed sheet material.

The present invention provides a sheet material conveyor having a pocket conveyor with at least one moving pocket for collecting printed sheet material, the pocket conveyor having a release area for releasing the printing sheet material in the pocket; and an air supply device providing air to the pocket at the release area.

The pocket may have a pocket foot which is released at the release area to drop the printed sheet material.

The pocket may include an angled collect wall having air holes for the air.

The air supply device may include an air manifold on each pocket connected to the air holes, and may include an air transfer unit for transferring air to the air manifold. The air transfer unit preferably is located at the release area. The air transfer unit, in one embodiment, may include a pressurized air source, a belt having holes interacting with the air manifold on the pocket, and a drive driven by the pocket.

The sheet material conveyor may include a further conveying unit located below the pocket at the release area. The further conveying unit may be a gripper conveying unit and may run at a speed similar to that of the pocket.

The present invention also provides a printed sheet material pocket having a collect wall, the collect wall having a plurality of air holes for providing pressurized air to printed sheet material collected on the collect wall.

The present invention also provides a method for transferring printed sheet material from a pocket conveyor, the method including the steps of providing pressurized air to the printed sheet material, and releasing the printed sheet material from the pocket while the pressurized air is being provided.

The method advantageously may further include first collating printed sheet material having different coefficients of friction in the pocket conveyor.

The method also may further include gripping the printed sheet material after the releasing step.

BRIEF DESCRIPTION OF THE DRAWINGS

An exemplary embodiments of the present invention is described below by reference to the following drawings, in which.

DETAILED DESCRIPTION

Figure 1:
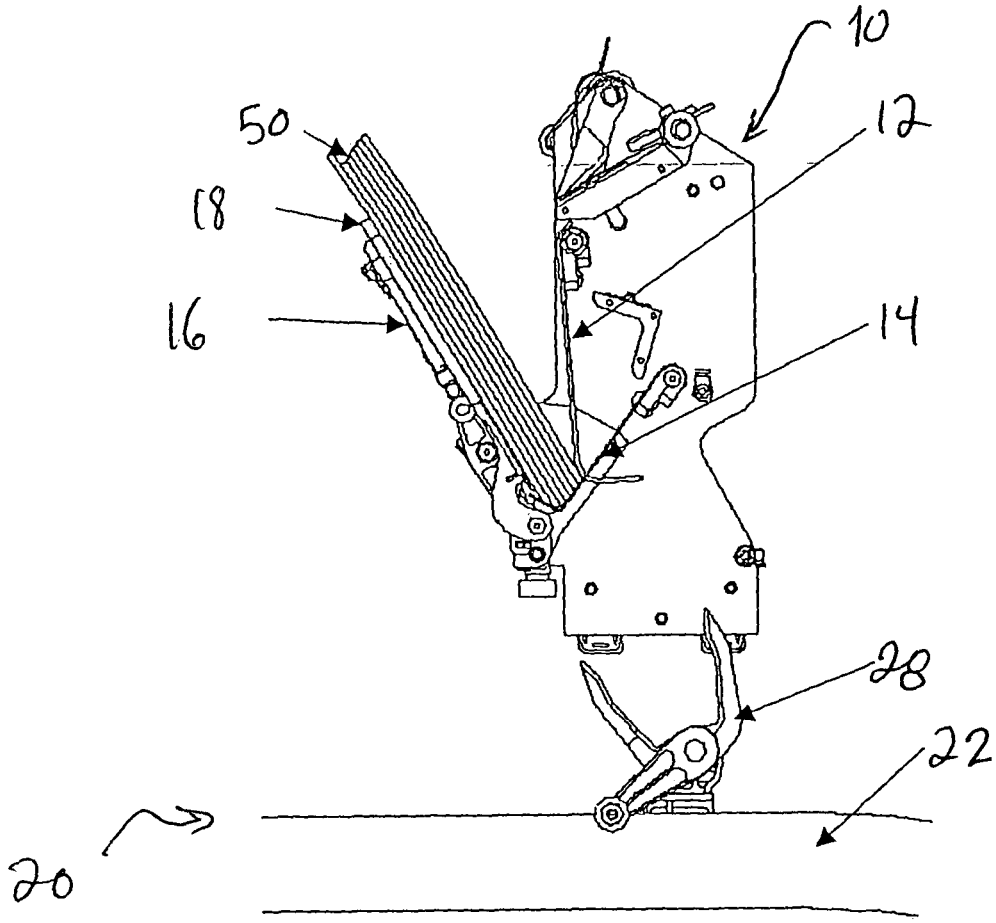
FIG. 1 shows a side view of a portion of a printed sheet material conveyor according to the present invention prior to release of the printed sheet material from a pocket.

FIG. 1 shows a moving pocket 10 above a gripper conveyor 20 with grippers 28 moving along a track 22. Pocket 10 may have a collect wall 18, and a foot 14. Printed sheet material 50 is collected, for example by collation, so as to be supported by foot 14 and so as to rest against collect wall 18. Collect wall 18 is angled with respect to the pocket travel direction and may be moveable or adjustable. Attached to collect wall 18 is an air manifold 16 for supplying low pressure air through air holes in collect wall 18 when the air manifold 16 is supplied with pressurized air.

Figure 5:
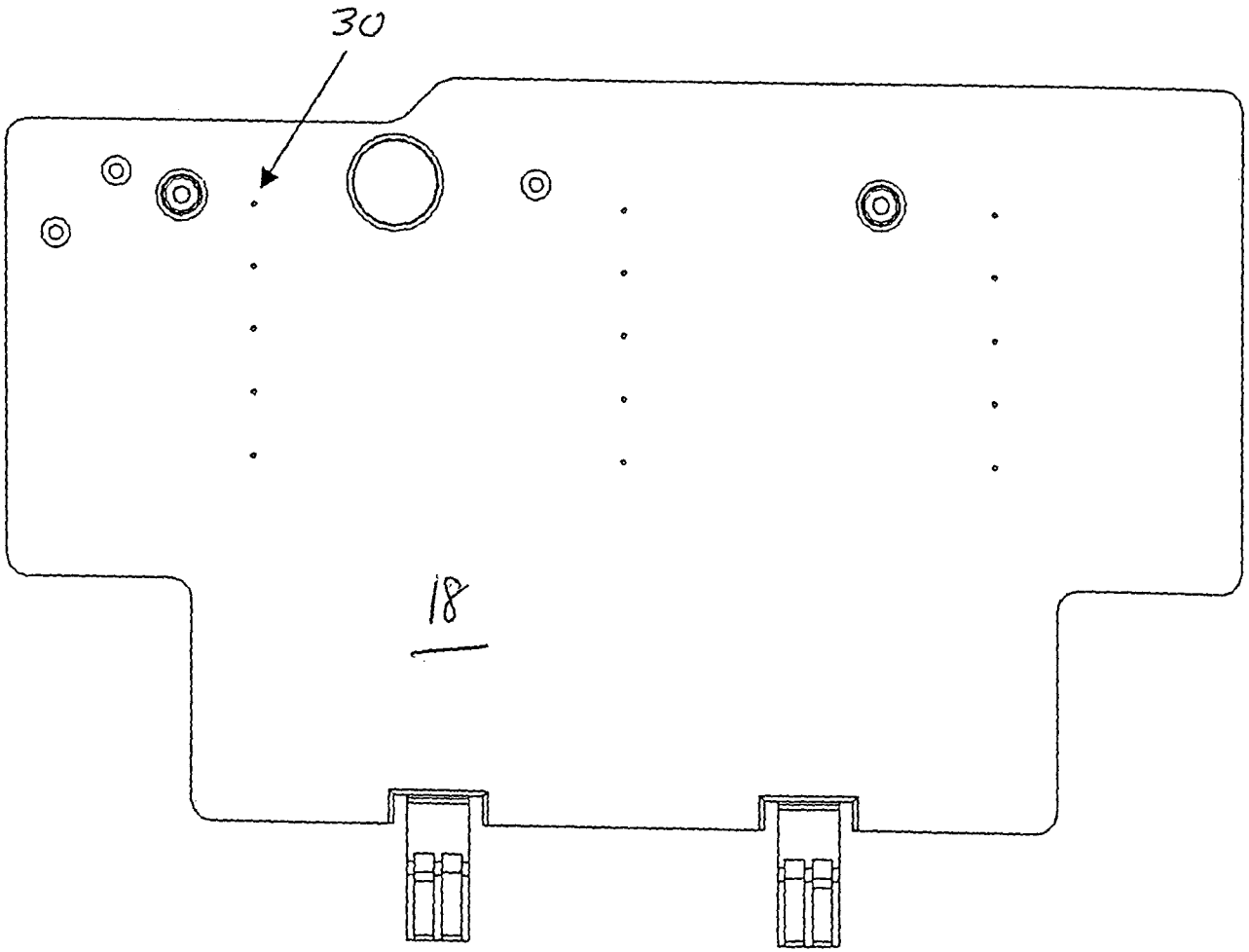
FIG. 5 shows details of the collect wall of a pocket according to the present invention.

As shown in FIG. 5, air holes 30 may be spaced across the width and height of collect wall 18, and the further apart holes in each direction preferably extending at least half the width of the printed material so as to be able to create a substantial air cushion between the wall 18 and printed sheet material 50.

Pocket 10, as shown in FIG. 1, may also further include a spring wall 12 which maintains the printed sheet material against the collect wall 18.

Figure 2:
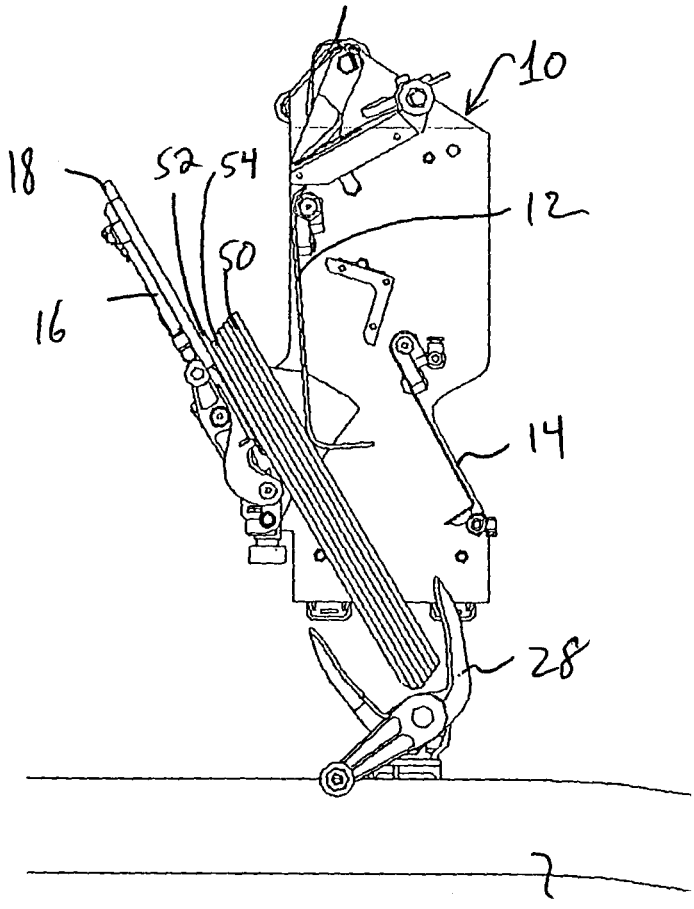
FIG. 2 shows a side view of a portion of a printed sheet material conveyor according to the present invention during release of the printed sheet material from a pocket.

As shown in FIG. 2, at a release station, foot 14 is pivoted to release the sheet material 50. Due to the air cushion between collect wall 18 and sheet material 50, the sheet material 50 may drop together into gripper 28. The present invention is particularly advantageous with respect to collated sheet material, as shown. For example, even if sheet material section 52 has a high coefficient of friction, for example section 52 is a non-glossy newspaper section, and sheet material section 54 has a lower coefficient of friction, for example section 54 is a glossy advertising section, the sections 52 and 54 can drop together, since the air cushion between wall 18 and section 52 reduces frictional forces to less than that between the sections 52 and 54.

Figure 3:
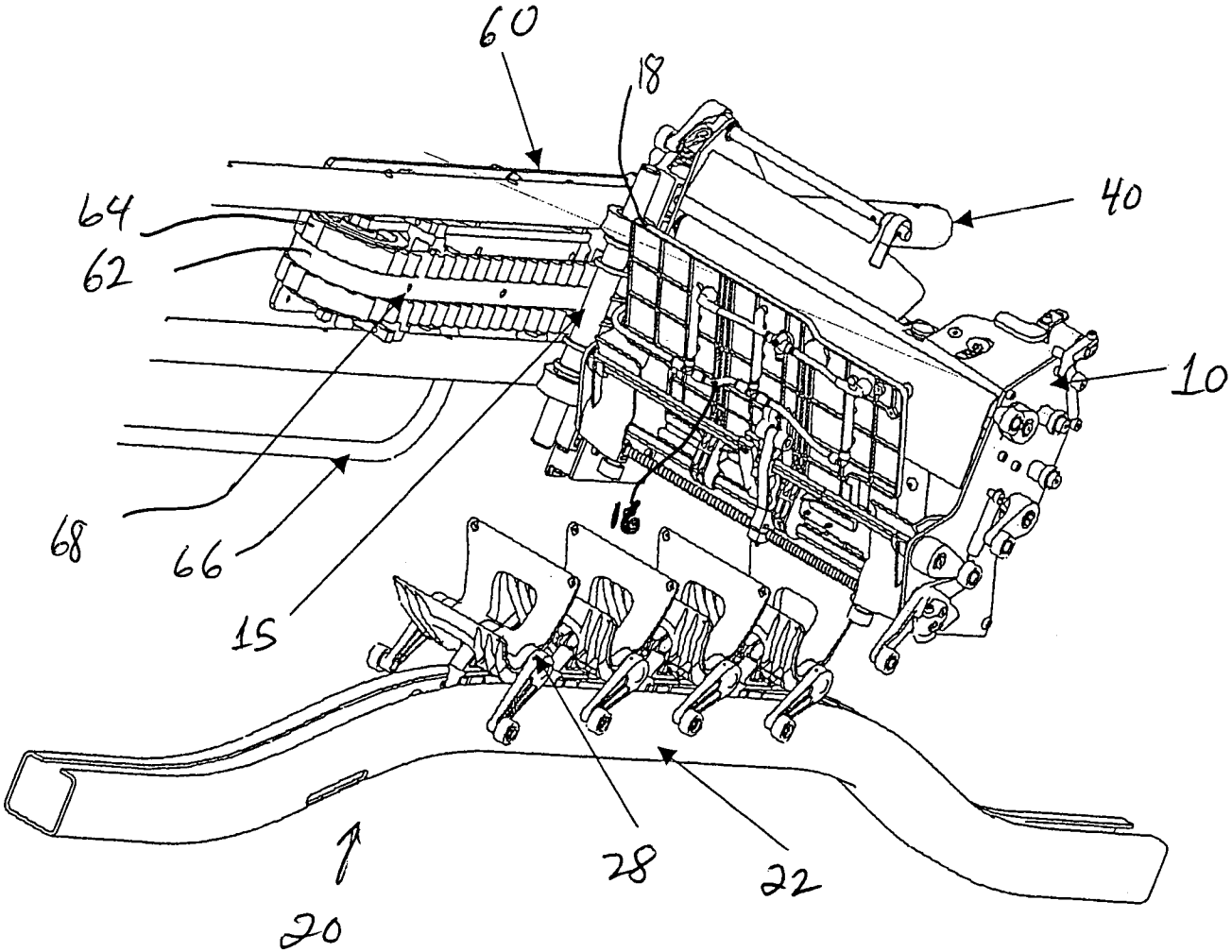
FIG. 3 shows a perspective view of a portion of a printed sheet material conveyor according to the present invention with a pocket in a release station.
Figure 4:
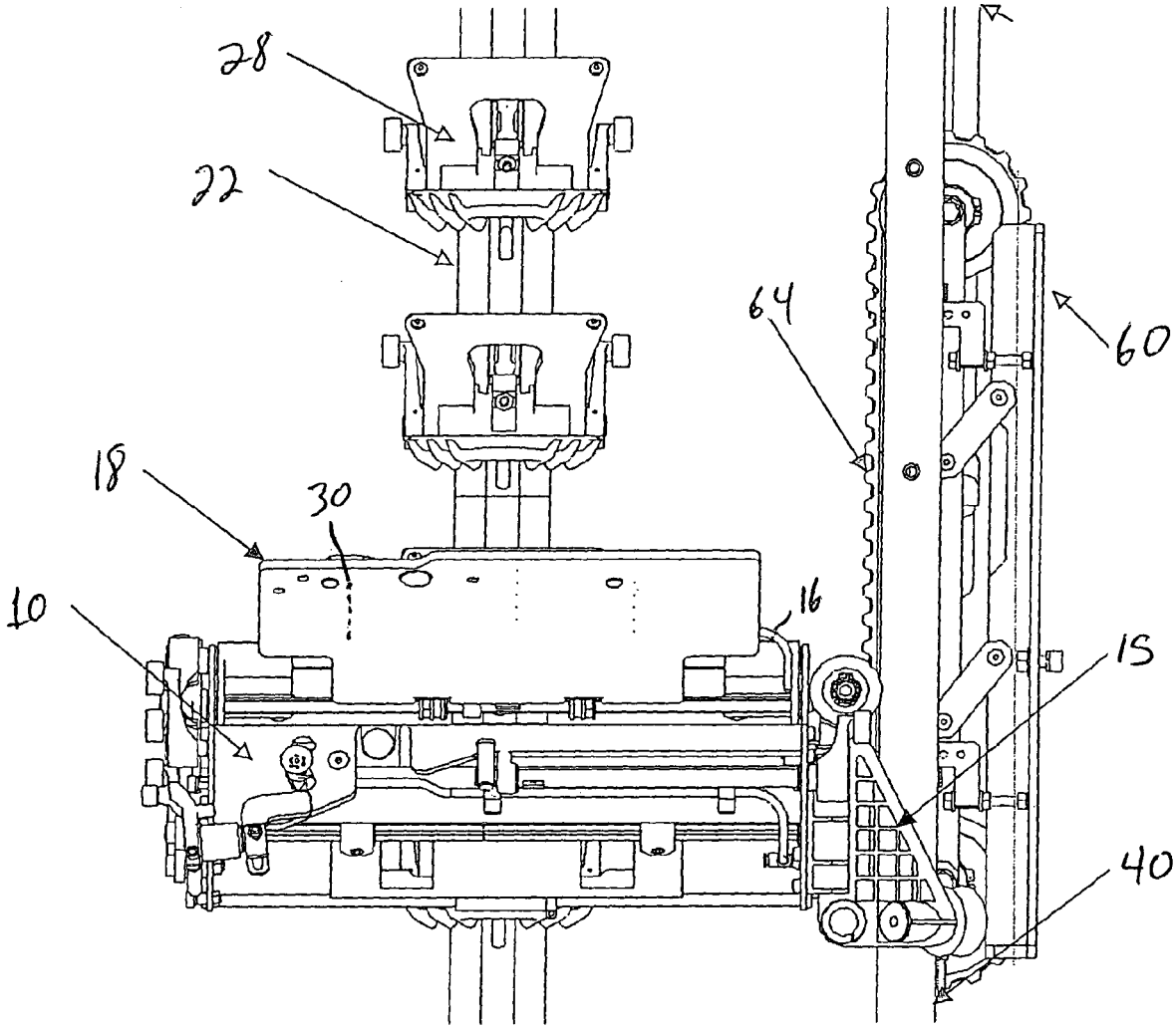
FIG. 4 shows a top view of the FIG. 3 portion.

FIG. 3 shows a perspective view of the conveyor according to the present invention at the release area. A plurality of pockets 10 run on track or rails 40, pockets 10 and rails 40 thus defining a pocket conveyor. A carrier 15 supports pocket 10 on rail 40 and ensures that manifold 16 lines up with an air transfer unit 60. Air transfer unit 60 includes a pressurized air source 66 providing pressurized air to an enclosed area behind a belt 62. On top and below the belt 62 may be driven by a toothed belt section 64, which may interact with teeth on the carrier 15 to drive the belt 62. Air holes 68 interact with manifold 16 as the belt 62 is driven by pocket 10, so that as pocket 10 passes by the belt 62, air is supplied via supply 66, through holes 68 to manifold 16 to holes 30 in collect wall 18. Air transfer unit 60 preferably is adjustable so that the air pressure provided through air holes 68 is adjustable. The actual air pressure desired will depend on the materials used in the pocket and the type and size of the printed sheet materials being collected and may be adjusted by the operator to ensure that the printed sheet materials are properly transferred.

Holes 68 may be open or have coverings that open when, for example, a protrusion of the manifold 16 passes into one of the holes 68.

Air as defined herein may include any compressible fluid.

LIST OF NUMERALS

10 pocket
12 spring wall
14 foot
15 carrier
16 manifold
18 collect wall
20 gripper conveyor
22 track
28 gripper
30 air holes
40 track
50 sheet material
52 section of sheet material
54 section of sheet material
60 air transfer unit
62 belt
64 toothed belt section
66 pressurized air supply
68 hole

What is claimed is:

1. A sheet material conveyor comprising:

a pocket conveyor with at least one moving pocket for collecting printed sheet material, the pocket conveyor having a release area for releasing the printing sheet material in the pocket; and an air supply device providing air to the pocket at the release area, the air supply device including an air source, the pocket being movable with respect to the air source, the air supply device including an air manifold on each pocket connected to air holes of each pocket.

2. The sheet material conveyor as recited in claim 1 wherein the pocket has apocket foot released at the release area to drop the printed sheet material.

3. The sheet material conveyor as recited in claim 1 wherein thepocket includes an angled collect wall having the air holes for the air.

4. The sheet material conveyor as recited in claim 1 wherein theair source transfers air to the air manifold.

5. The sheet material conveyor as recited in claim 4 wherein the airsource is stationary and is located at the release area.

6. The sheet material conveyor as recited in claim 4 wherein the airsource is a pressurized air source, a belt having holes interacting with the air manifold on thepocket, and a drive driven by the pocket.

7. The sheet material conveyor as recited in claim 1 wherein the air supply device is adjustable to vary pressure of the air supplied to the pocket.

8. The sheet material conveyor as recited in claim 1 wherein the at least onepocket includes a plurality of pockets.

9. The sheet material conveyor as recited in claim 1 further including a further conveying unit located below the pocket at the release area.

10. The sheet material conveyor as recited in claim 9 wherein the further conveying unit is a gripper conveying unit.

11. A sheet material conveyor comprising:

a pocket conveyor with at least one moving pocket for collecting printed sheet material, the pocket conveyor having a release area for releasing the printing sheet material in the pocket; and an air supply device providing air to the pocket at the release area;

the air supply device including an air manifold on each pocket connected to the air holes and an air-transfer unit for transferring-air to the air manifold, the air transfer unit including a pressurized air source, a belt having holes interacting with the air manifold on the pocket, and a drive driven by the pocket.

* * * * *